US007058337B2

(12) United States Patent
Hashimoto et al.

(10) Patent No.: US 7,058,337 B2
(45) Date of Patent: Jun. 6, 2006

(54) PROCESS CARTRIDGE AND ELECTROPHOTOGRAPHIC IMAGE FORMING APPARATUS

(75) Inventors: Koji Hashimoto, Shizuoka-ken (JP); Kazuhiko Kanno, Odawara (JP); Kinya Harada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 10/840,263

(22) Filed: May 7, 2004

(65) Prior Publication Data

US 2005/0047822 A1 Mar. 3, 2005

(30) Foreign Application Priority Data

Aug. 29, 2003 (JP) ..... 2003-307907
Apr. 30, 2004 (JP) ..... 2004-135535

(51) Int. Cl.
*G03G 21/18* (2006.01)

(52) U.S. Cl. ..... 399/111; 399/113

(58) Field of Classification Search ..... 399/111, 399/113, 112
See application file for complete search history.

(56) References Cited

U.S. PATENT DOCUMENTS

| | | | | |
|---|---|---|---|---|
| 5,729,796 | A | 3/1998 | Miura et al. | 399/114 |
| 5,740,500 | A | 4/1998 | Hashimoto | 399/114 |
| 5,768,658 | A | 6/1998 | Watanabe et al. | 399/111 |
| 5,815,644 | A | 9/1998 | Nishuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,923,924 | A | 7/1999 | Hashimoto | 399/111 |
| 5,926,666 | A | 7/1999 | Miura et al. | 399/25 |
| 5,937,240 | A | 8/1999 | Kanno et al. | 399/111 |
| 5,940,657 | A | 8/1999 | Yokomori et al. | 399/119 |
| 5,950,049 | A | 9/1999 | Yokomori et al. | 399/119 |
| 6,016,408 | A | 1/2000 | Hashimoto et al. | 399/27 |
| 6,044,235 | A | 3/2000 | Hashimoto | 399/99 |
| 6,070,029 | A | 5/2000 | Nishuwatoko et al. | 399/111 |
| 6,072,969 | A | 6/2000 | Yokomori et al. | 399/119 |
| 6,101,352 | A | 8/2000 | Hashimoto et al. | 399/119 |
| 6,151,459 | A | 11/2000 | Hashimoto et al. | 399/27 |
| 6,246,853 | B1 | 6/2001 | Suzuki et al. | 399/262 |
| 6,324,357 | B1 | 11/2001 | Gomi et al. | 399/50 |
| 6,345,164 | B1 | 2/2002 | Yokomori et al. | 399/119 |
| 6,381,430 | B1 | 4/2002 | Yokomori et al. | 399/119 |

(Continued)

FOREIGN PATENT DOCUMENTS

JP 2001-337511 12/2001

*Primary Examiner*—Susan S. Y. Lee
*Assistant Examiner*—Laura K. Roth
(74) *Attorney, Agent, or Firm*—Fitzpatrick, Cella, Harper & Scinto

(57) ABSTRACT

A process cartridge is detachably mountable to a main assembly of an electrophotographic image forming apparatus that includes a cam movable between first and second positions. The cartridge includes an electrophotographic photosensitive drum, a developing roller developing an electrostatic latent image formed on the drum, a first frame for supporting the drum, a second frame for supporting the roller and connected with the first frame for relative rotation about a shaft disposed downstream of the roller with respect to a cartridge mounting direction, an entering portion at one end of the second frame with respect to a drum longitudinal direction and downstream of the shaft with respect to the mounting direction, permitting at least a part of the cam to enter when the process cartridge is mounted to the apparatus, and a cam engaging portion engaging the cam to receive a force for spacing the drum and the roller from each other.

23 Claims, 10 Drawing Sheets

U.S. PATENT DOCUMENTS 6,389,243 B1 * 5/2002 Makino ..... 399/53
6,466,755 B1 * 10/2002 Yano et al.
6,496,667 B1 12/2002 Shiratori et al. ..... 399/103
6,505,021 B1 1/2003 Shibuya et al. ..... 399/149
6,516,168 B1 2/2003 Shiratori et al. ..... 399/103
6,560,422 B1 5/2003 Kanno et al. ..... 399/106
6,681,088 B1 * 1/2004 Kanno et al. ..... 399/111
6,735,403 B1 5/2004 Kanno et al. ..... 399/103
6,795,671 B1 * 9/2004 Matsuoka ..... 399/223
2002/0061196 A1 5/2002 Miyamoto et al. ..... 399/27
2003/0086723 A1 5/2003 Yamaguchi et al. ..... 399/119
2003/0142994 A1 7/2003 Harada et al. ..... 399/111
2003/0156848 A1 8/2003 Kawai et al. ..... 399/27
2003/0156855 A1 8/2003 Nittani et al. ..... 399/106
2004/0037587 A1 2/2004 Yamaguchi et al. ..... 399/119
2004/0076441 A1 * 4/2004 Matsuguma et al. ..... 399/26
2005/0047828 A1 * 3/2005 Kawai ..... 399/126
2005/0053394 A1 * 3/2005 Ishii et al. ..... 399/111

* cited by examiner

PROCESS CARTRIDGE AND ELECTROPHOTOGRAPHIC IMAGE FORMING APPARATUS

FIELD OF THE INVENTION AND RELATED ART

The present invention relaters to a process cartridge and an electrophotographic image forming apparatus.

Here, an electrophotographic image forming apparatus is an apparatus which forms an image on a recording medium (paper, OHP sheet, fabric, etc.) with the use of one of the electrophotographic image forming methods. As examples of electrophotographic image forming apparatus, there are an electrophotographic copying machine, an electrophotographic printer (for example, a laser beam printer, an LED printer, etc.), a facsimile apparatus, a word processor, etc.

A process cartridge is a cartridge in which a minimum of a developing means as a processing means is integrally disposed in combination with an electrophotographic photosensitive drum, and which is removably mountable in the main assembly of an electrophotographic image forming apparatus.

In the field of an electrophotographic image forming apparatus, it has been common practice to employ one of the process cartridge systems, according to which an electrophotographic photosensitive drum (which hereinafter will be referred to simply as a photosensitive drum), and a single or multiple processing means which act on the electrophotographic photosensitive drum, are integrally disposed in a cartridge removably mountable in the main assembly of an image forming apparatus. The employment of a process cartridges system makes it possible for a user to maintain an image forming apparatus by the user alone, that is, without relying on service personnel. Therefore, process cartridge systems are widely in use in the field of an electrophotographic image forming apparatus.

As an example of the above described process cartridge (which hereinafter will be referred to simply as "cartridge"), there has been known a process cartridge of a contact type, in which a photosensitive drum, and a developing member which develops a latent image on the photosensitive drum by being placed in contact with the photosensitive drum, are, integrally disposed.

In the case of this type of a process cartridge, a predetermined amount of contact pressure is maintained between the development roller and photosensitive drum, during image formation. In other words, during image formation, the development roller is always kept pressed upon the photosensitive drum.

Thus, the toner on the development roller adheres to the photosensitive drum even when an image is not being formed. Further, it is possible that the toner having adhered to the photosensitive drum while an image is not formed will transfer onto recording medium, soiling thereby the recording medium.

Also in the case of a process cartridge of the above described contact type, the development roller is kept always in contact with the photosensitive drum as described above. Thus, if a cartridge is not used for a long time after its installation into the main assembly of an image forming apparatus, it is possible that elastic layer of the development roller therein will suffer from permanent deformation, which results in the formation of an image suffering from nonuniformity attributable to the deformation of the development roller.

Thus, it has been proposed an image forming apparatus structured so that the development roller is allowed to take a position in which it remains in contact with the photosensitive drum, and another position in which it does not contact the photosensitive drum (U.S. Pat. No. 6,389,243).

There has also been proposed a color image forming apparatus structured so that its first housing, or the housing in which the photosensitive drum is held, and its second housing, or the housing in which the development roller is held, can be rotated about a common axis in order to make it possible to keep the development roller away from the photosensitive drum when forming no image, and to keep the development roller in contact with the photosensitive drum when forming an image (Japanese Laid-open Patent Application 2001-337511).

SUMMARY OF THE INVENTION

The present invention was made in consideration of the prior arts described above, and its primary object is to provide a process cartridge capable of making it possible to reduce the size of an electrophotographic image forming apparatus, and an electrophotographic image forming apparatus in which the process cartridge is removably mountable.

Another object of the present invention is to provide a spatially efficient process cartridge structured so that its electrophotographic photosensitive member and development roller can be placed in contact with each other, or separated from each other, and an electrophotographic: image forming apparatus in which the process cartridge is removably mountable.

Another object of the present invention is to provide a spatially efficient process cartridge structured so that its electrophotographic photosensitive member and development roller can be precisely placed in contact with each other, or precisely separated from each other, and an electrophotographic image forming apparatus in which the process cartridge is removably mountable.

Another object of the present invention is to provide a process cartridge structured so that when the process cartridge is in the main assembly, clearances are provided, into which a minimum of a part of the cam of the main assembly of an electrophotographic image forming apparatus is allowed to enter, and an electrophotographic image forming apparatus in which the process cartridge is removably mountable.

According to an aspect of an embodiment of the present invention which accomplishes the above-described objects, a process cartridge removably mountable in the main assembly of an electrophotographic image forming apparatus having cams enabled to take a first position (force transmitting position) and a second position (neutral position), comprises an electrophotographic photosensitive drum; a development roller which is to be placed in contact with the electrophotographic photosensitive drum in order to develop an electrostatic latent image formed on the electrophotographic photosensitive drum; a first frame for supporting the electrophotographic photosensitive drum; a second frame which is for supporting the development roller, and is connected to the frame, with the use of a shaft located downstream of the development roller in terms of the direction in which the process cartridge is inserted into the main assembly, so that the second frame can be rotated about the axial line of the shaft; clearances (voids) which are located at the ends of the second frame in terms of the direction parallel to the lengthwise direction of said electrophotographic photosensitive drum, and downstream of the above-mentioned shaft in terms of the cartridge insertion direction, and into which the cams of the image forming apparatus main assembly are allowed to enter one for one, at least partially, when the process cartridge is in the apparatus main assembly; and cam followers which receive from the above-mentioned cams the force for separating the development roller from the electrophotographic photosensitive drum, by coming into contact with the cams as the cams move into the above-mentioned first positions, and which are located downstream of said clearances.

According to another aspect of the embodiment of the present invention, an electrophotographic image forming apparatus which is for forming an image on recording medium, and in which a process cartridge is removably mountable, comprises (i) cams capable of taking a first position (force transmitting position), and a second position (neutral position); (ii) a means for removably mounting a process cartridge comprising: an electrophotographic photosensitive drum; a development roller which is to be placed in contact with the electrophotographic photosensitive drum in order to develop an electrostatic latent image formed on the electrophotographic photosensitive drum; a first frame for supporting the electrophotographic photosensitive drum; a second frame which is for supporting the development roller, and is connected to the first frame, with the use of a shaft located downstream of the development roller in term of the direction in which the process cartridge is inserted into the main assembly, so that the second frame can be rotated about the axial line of the shaft; clearances (voids) which are located at the ends of the second frame in terms of the direction parallel to the lengthwise direction of the electrophotographic photosensitive drum, and downstream of the above-mentioned shaft in terms of the cartridge insertion direction, and into which the cams of the image forming apparatus main assembly are allowed to enter once for one, at least partially, when the process cartridge is in the apparatus main assembly; and cam followers which receive from the above-mentioned cams the force for separating the development roller from the electrophotographic photosensitive drum, by coming into contact with the cams as the cams move into the above mentioned first positions, and which are located downstream of the clearances; and (iii) a means for conveying the abovementioned recording medium.

As will be evident from the above description of the present invention, according to the present invention, it is possible to provide a spatially efficient process cartridge enabled to place its development roller in contact with, or separate it, from its electrophotographic photosensitive drum, and also, it is possible to reduce in size an electrophotographic image forming apparatus.

Also according to the present invention, it is possible to precisely place a development roller in contact with, or separate it from, an electrophotographic photosensitive drum.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the present invention will be described referring to the appended drawings and the preferred embodiments given below. Incidentally, the materials and configurations of the structural components, and their positional relationship, in the following embodiments, are not intended to limit the scope of the present invention, unless specifically noted. Further, if a given structural component is described regarding its material, configuration, etc., in one of the following embodiments, it will be the same throughout all the following embodiments, unless it is differently described.

In the following descriptions of the preferred embodiments, the lengthwise direction of a cartridge means the direction intersecting (roughly perpendicular to) the direction in which the cartridge is inserted into the main assembly of an electrophotographic image forming apparatus; it means the direction parallel to the lengthwise direction of the electrophotographic: photosensitive drum and the lengthwise direction of the development roller. The top and bottom surfaces of a cartridge are the external surfaces of the cartridge, which face upward and downward, respectively, when the cartridge is in the apparatus main assembly.

Embodiment 1

(General Structure of Electrophotographic Image Forming Apparatus]

Figure 1:
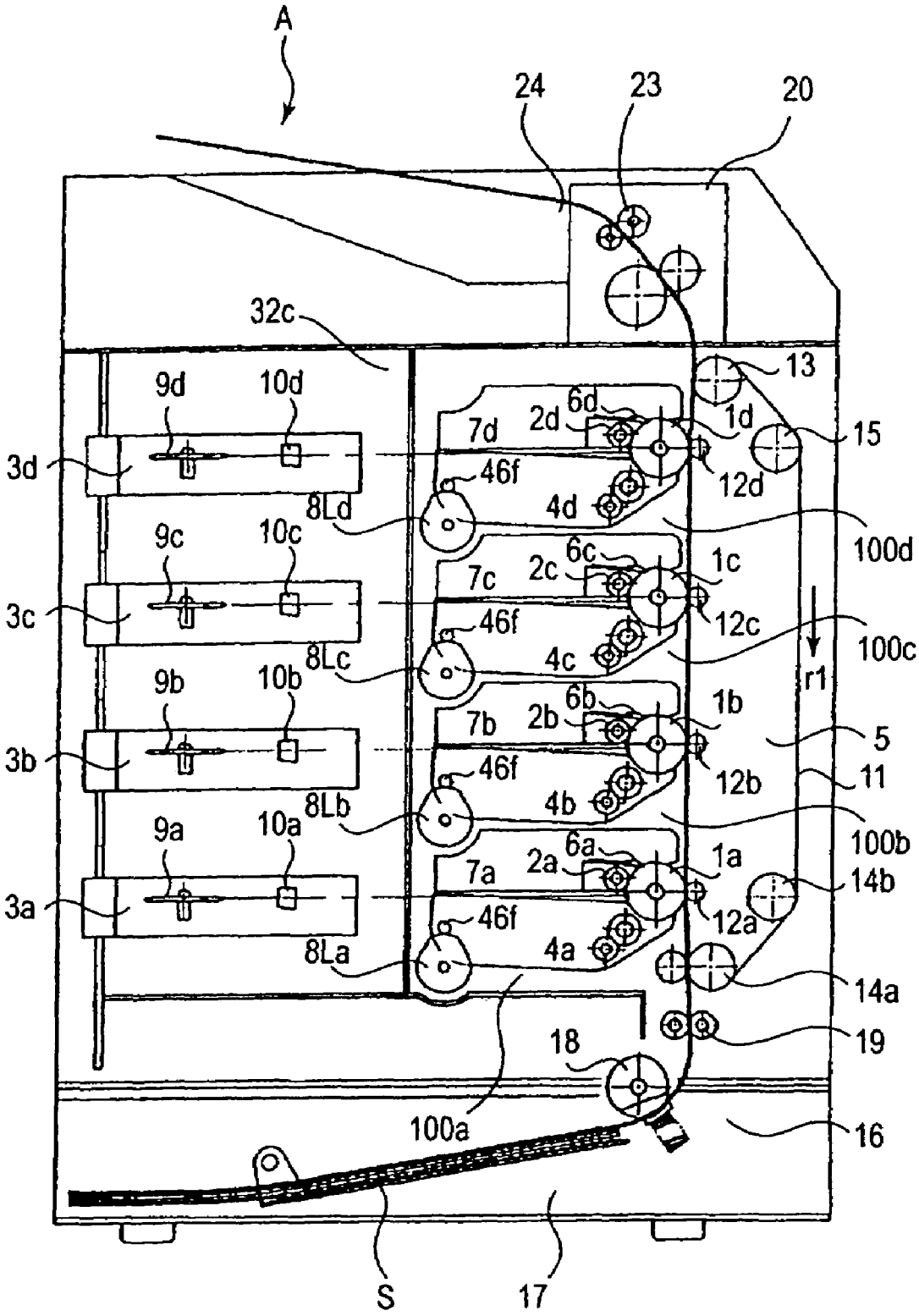
FIG. 1 is a sectional view of the electrophotographic color image forming apparatus in the preferred embodiment of the present invention.
Figure 3:
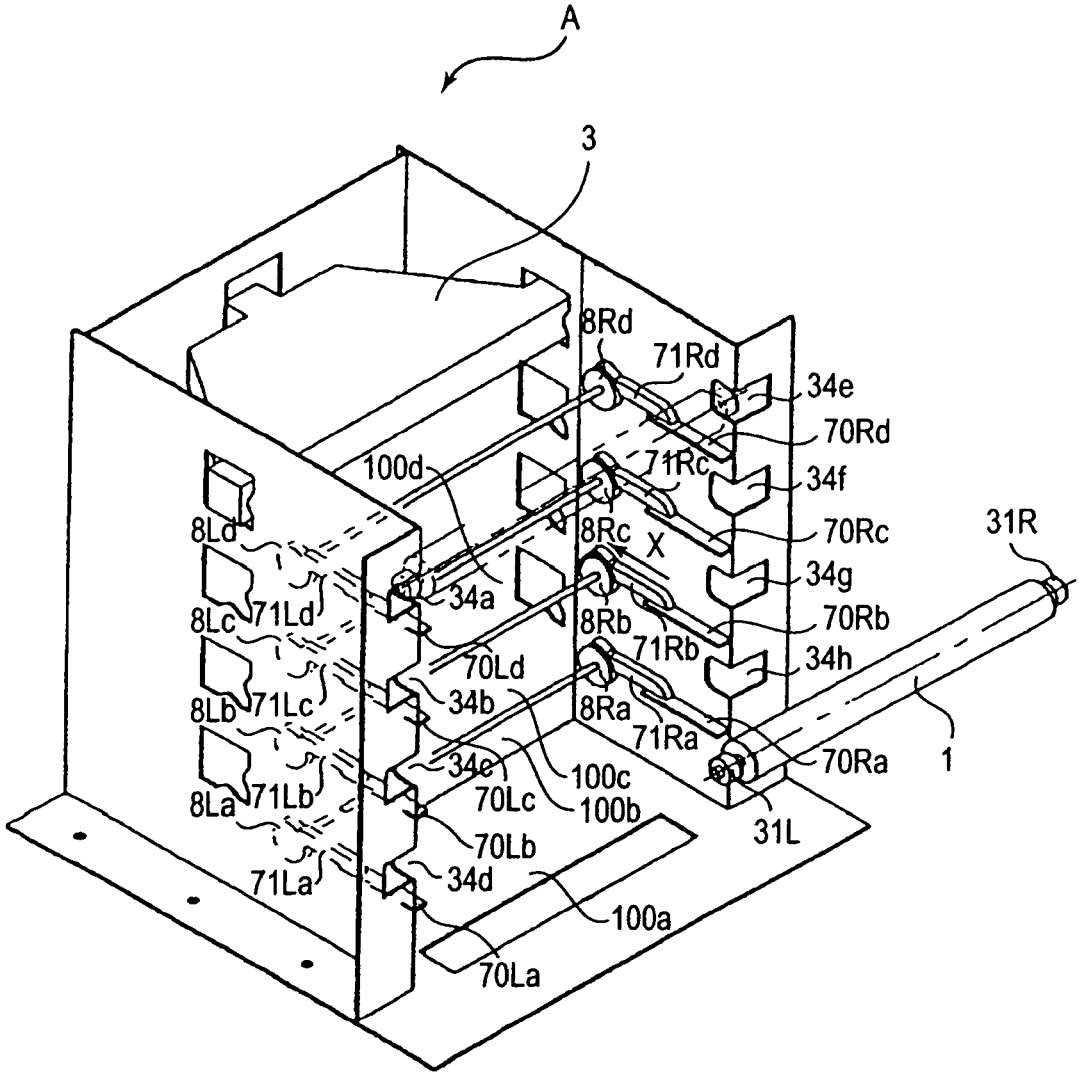
FIG. 3 is a perspective phantom view of the main assembly of the image forming apparatus in then preferred embodiment of the present invention, showing how the process cartridge is mounted into the main assembly.

First, referring to FIG. 1, the electrophotographic image forming apparatus in this embodiment will be described regarding its general structure. FIG. 1 is a sectional view of the electrophotographic color image forming apparatus in this embodiment, and FIG. 3 is a perspective phantom view of the same image forming apparatus, showing the internal structure thereof.

The electrophotographic image forming apparatus A (which hereinafter will be referred to simply as the "image forming apparatus") comprises four sets of cartridge mounting means (70Ra–70Rd, 70La–70Ld, 71Ra–71Rd, 71La–71Ld, and 34*a*–34*h*), which are vertically stacked (the height direction of image forming apparatus A) at predetermined intervals. The cartridges 7 (7*a*–7*d*) each comprise an electrophotographic photosensitive drum 1 (1*a*, 1*b*, 1*c*, or 1*d*) (which hereinafter will be referred to as the "photosensitive drum") (FIGS. 1 and 3).

The photosensitive drum 1 is rotationally driven in the counterclockwise direction (FIG. 1) by a driving means (unshown). Placed along the peripheral surface of the photosensitive drum 1 are: a charge roller 2(2*a*–2*d*) as a charging means for uniformly charging the peripheral surface of the photosensitive drum 1; a scanner unit 3 (3*a*–3*d*) for forming an electrostatic latent image on the peripheral surface of the photosensitive drum 1 by projecting a beam of light modulated with the image formation data, onto the peripheral surface of the photosensitive drum 1; a development unit 4 (4*a*–4*d*) for developing the electrostatic latent image, with the use of toner as developer; a transferring means 5 for transferring the toner image formed on the peripheral surface of the photosensitive drum 1, onto a recording medium S; and a cleaning blade 6 (6*a*–6*d*) as a cleaning means for removing the toner remaining on the peripheral surface of the photosensitive drum 1 after the toner image transfer, listing in the order of the usage in an image forming operation. The photosensitive drum 1, the charge roller 2, the development unit 4, the blade 6, etc., are in the cartridge 7.

The photosensitive drum 1 comprises an aluminum cylinder, and a layer of organic photoconductive substance (OPC) covering virtually the entirely of the peripheral surface of the aluminum cylinder. The photosensitive drum 1 is rotationally supported by the supporting members, by its lengthwise end portions. One of the lengthwise ends of the photosensitive drum 1 is provided with a driving force transmission member (unshown) to which driving force is transmitted from a motor (unshown). With the transmission of the driving force to the driving force transmission member, the photosensitive drum 1 is rotationally driven in the counterclockwise direction.

The charge roller 2 is an electrically conductive roller, and is placed in contact with the peripheral surface of the photosensitive drum 1. As charge bias voltage is applied to the charge roller 2, the peripheral surface of the photosensitive drum 1 is uniformly charged.

The scanner 3 is positioned in the roughly horizontal direction from the photosensitive drum 1. The image formation light is emitted by a laser diode (unshown), while being modulated with image formation signals, toward the polygon mirror (9*a*–9*d*), which is being rotated by a scanner motor (unshown). Thus, the image formation light is reflected by the mirror, and is focused on the peripheral surface of the photosensitive drum 1 through the focal lens (10*a*–10*d*), selectively exposing thereby numerous points on the peripheral surface of the photosensitive drum 1. As a result, an electrostatic latent image in accordance with the image formation signals is formed on the peripheral surface of the photosensitive drum 1.

Figure 2:
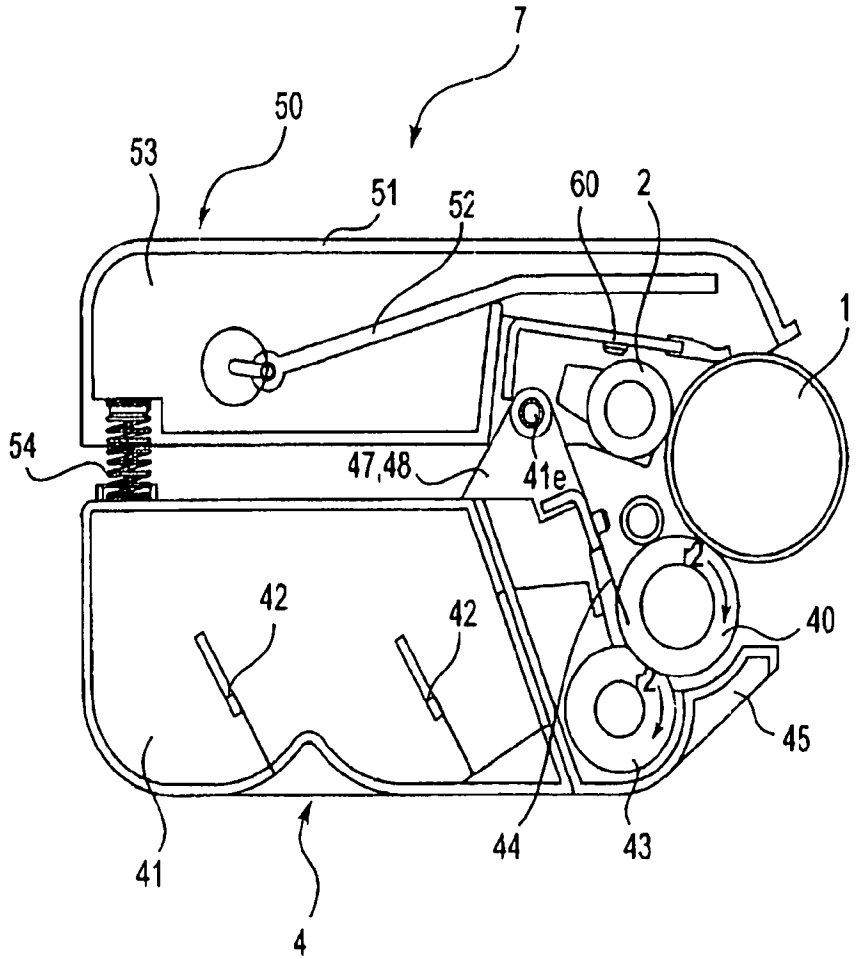
FIG. 2 is a sectional view of the process cartridge in the preferred embodiment of the present invention.

Referring to FIG. 2, the development unit 4 (4*a*–4*d*) comprises a first frame 41 and a second frame 45. The first frame 41 constitutes a toner container, and the second frame 45 constitutes a developing means container. The four toner containers 41 of their respective development units 4 contain a different one of yellow, magenta, cyan, and black toner, respectively.

The toner is conveyed to the toner supply roller 43 by the toner conveyance mechanism 42 in the toner container 41. Then, the toner is coated, while being charged, on the peripheral surface of the development roller 40 as a developing member, by the toner supply roller 43, and the development blade 44 kept pressed on the peripheral surface of the development roller 40.

As development bias is applied to the development roller 40, the electrostatic latent image on the peripheral surface of the photosensitive drum 1 is developed with the toner on the peripheral surface of the development roller 40. The development roller 40 is positioned so that its peripheral surface is opposes tie peripheral surface of the photosensitive drum 1.

The image forming apparatus main assembly A is provided with a transfer belt 11, which is placed in contact with all of the photosensitive drums 1*a*–1*d*. The transfer belt 11 is circularly driven. The transfer belt 11 is a belt formed of thin film. It is by the transfer belt 11 that a recording medium S is conveyed to a transfer station, in which the toner image on the peripheral surface of the photosensitive drum 1 is transferred onto the recording medium S.

The transfer rollers (12*a*–12*d*) are in contact with the transfer belt 11, on the inward surface in terms of the loop formed by the transfer belt 11, sandwiching the transfer belt 11 between the transfer rollers (12*a*–12*d*) and photosensitive drum 1 (photosensitive drum 1*a*–1*d*). To the recording medium S, positive electric charge is applied by the charge roller 2 through the transfer belt 11. As a result, the toner image on the peripheral surface of the photosensitive drum 1 is transferred onto the recording medium S. The transfer belt 11 is extended around four rollers, that is, the driving roller 13, follower rollers 14*a* and 14*b*, and tension roller 15, and is circularly driven (in the direction indicated by an arrow mark r1). More specifically, the toner image is transferred onto the recording medium S while the recording medium S is conveyed from the follower roller 14*a* side to the driving roller 13 side by the transfer belt 11.

The recording medium feeding portion 16 is a portion for conveying the recording medium S to the image formation station. It comprises a recording medium feeding cassette 17 in which multiple recording media are stored. In an image forming operation, a feeding roller 18, and a pair of registration rollers 19, are rotated in accordance with the progression of the image formation operation, so that the recording media S in the cassette 17 are fed into the main assembly of the image forming apparatus, while being separated from the following recording media S. More specifically, as the leading edge of each recording medium S comes into contact with the pair of registration rollers 19, its advancement is temporarily interrupted by the pair of registration roller 19, and then, is released in synchronism with the rotation of the transfer belt 11 and the movement (formation) of a toner image, to be delivered to the transfer belt 11.

The fixing portion 20 fixes the multiple toner images, different in color, having just been transferred, onto the recording medium S.

The gist of an image forming operation is as follows: First, the cartridges 7 (7*a*–7*d*) begin to be sequentially driven in synchronism with the image formation timing, and therefore, the photosensitive drums 1 (1*a*–1*d*) begin to be rotationally driven, and so are the scanner units 3 (3*a*–3*d*) which correspond to the cartridges 7 (7*a*–7*d*), respectively. As a result, the peripheral surface of each photosensitive drum 1 is uniformly charged by the corresponding charging means 2. Then, the uniformly charged peripheral surface of the photosensitive drum 1 is exposed in accordance with the image formation signals by the corresponding unit 3. As a result, an electrostatic latent image is formed on the peripheral surface of the photosensitive drum 1. This electrostatic latent image is developed by the corresponding development roller 40.

As described above, the toner images on the photosensitive drums 1 (1*a*–1*d*), one for one, are sequentially transferred onto the recording medium S by the electric fields formed between the photosensitive drums 1 (1*a*–1*d*) and transfer rollers (12*a*–12*d*), respectively; in other words, four toner images different in color are sequentially transferred onto the recording medium S. Then, the recording medium S on which four color toner images are borne is separated from the transfer belt 11 by utilizing the curvature of the driving roller 13, and then, is conveyed into the fixing portion 20. In the fixing portion 20, the toner images on the recording medium S are thermally fixed to the recording medium S. Thereafter, the recording medium S is discharged from the apparatus main assembly A through the delivery portion 24, by the pair of discharge rollers 23.

(Process Cartridge)

Next, referring to FIG. 2, the cartridge 7 (7*a*–7*d*) in this embodiment will be described. FIG. 2 is a sectional view of the cartridge 7 in this embodiment.

Since the cartridge 7*a* which stores yellow toner, the cartridge 7*b* which stores magenta toner, the cartridge 7*c* which stores cyan toner, and the cartridge 7*d* which stores black tonier, are identical in structure, only the cartridge 7*a* will be described.

The cartridge 7 comprises the photosensitive member unit 50 and development unit 40, which are connected to each other so that they can be pivoted about the axis of the member by which they are connected. The photosensitive member unit 50 contains the photosensitive drum 1, the charge roller 2, and the cleaning blade 6, whereas the development unit 4 contains the developing means.

More specifically, the photosensitive member unit 50 comprises the cleaning means frame 51 as the first frame, and the photosensitive drum 1 rotationally supported by the cleaning means frame 51, with the pair of bearings 31L and 31R placed between the cleaning frame 51 and the photosensitive drum 1. The photosensitive member unit 50 also comprises the charge roller 2, and a blade 60, which are disposed in the adjacencies or the peripheral surface of the photosensitive drum 1. The residual toner, that is, the toner remaining on the peripheral surface of the photosensitive drum 1 after the above-mentioned toner image transfer from the peripheral surface of the photosensitive drum 1, is removed from the peripheral surface of the photosensitive drum 1 by the blade 60, and is sent by a toner conveyance mechanism 52 to a toner chamber 53, which is located in the rear portion of the cleaning means frame 51. To the photosensitive member unit 50, a driving force is transmitted from a motor (unshown), to rotate the photosensitive drum 1 in synchronism with the progression of the image forming operation. This motor (unshown) for driving the photosensitive drum 1 is on the main assembly A side.

The development unit 4 comprises: the development roller 40, which is rotated in contact with the photosensitive drum 1 (in the direction indicated by an arrow mark r2); the aforementioned toner container 41; and the developing means frame 45 as the second frame. The development roller 40 is rotationally supported by is the developing means frame 45 with the pair of bearings 47 and 48 placed the between the development roller 40 and frame 45. The development unit 4 also comprises the toner supply roller 43 and the development blade 44, which are located in the adjacencies of the peripheral surface of the development roller 40. In the toner container 41, the toner conveyance mechanism 42 is disposed, which is for conveying the toner in the toner container 41, to the toner supply roller 43 while stirring the toner.

Further, the development unit 4 is connected to the photosensitive member unit 50 in such a manner that the development unit 4 can be rotationally moved relative to the unit 50. More specifically, the development unit 4 and photosensitive member unit 50 are connected to each other by the shaft 41*e* of the developing means frame 45 so that the development unit 4 can be pivot about the shaft 41*e* to place the development roller 40 in contact with, or to separate it from the photosensitive drum 1.

When the cartridge 7 is not in the apparatus main assembly A, the development roller 40 is kept in contact with the photosensitive drum 1 by the force generated by a pair of springs 54 (compression springs) in the direction to rotate the development unit 4 about the axis 41*e*.

(Mechanism for Keeping Developing Member Separated from Photosensitive Drum)

Figure 4:
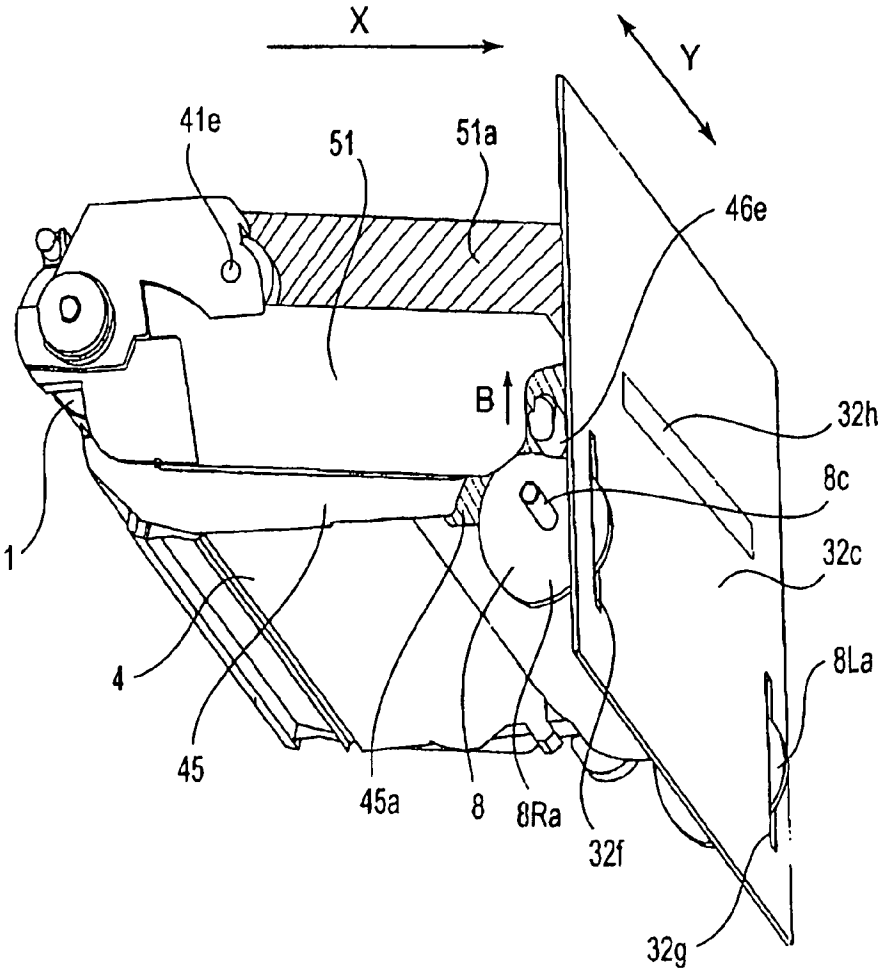
FIG. 4 is a perspective view of the development roller separation mechanism and its adjacencies in the preferred embodiment of the present invention, showing the structure of the mechanism.
Figure 5:
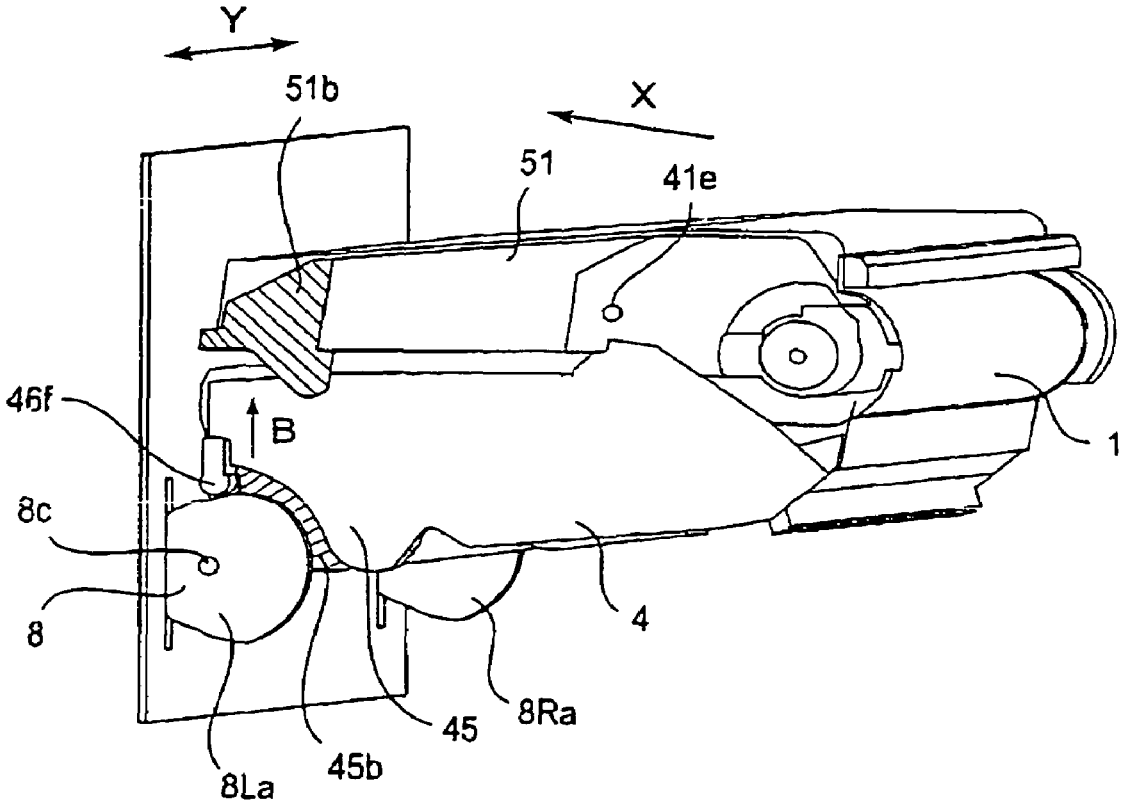
FIG. 5 is a perspective view of the development roller separation mechanism and its adjacencies in the preferred embodiment of the present invention, showing the structure of the mechanism.

Next, referring to FIGS. 3–5, the mechanism for keeping the developing member separated from the photosensitive drum when the cartridge 7 is in the apparatus main assembly A, will be described. FIG. 3 is a perspective view of the apparatus main assembly A, for showing how the cartridge 7 is mounted into the apparatus main assembly A. FIGS. 4 and 5 are perspective views of the cartridge 7 and development roller separating member, showing the mechanism for keeping the development roller separated from the photosensitive drum. In FIG. 3, the cartridge 7 is not shown in entirety; only the photosensitive drum 1 and bearings 31L and 31R are shown, in order to make it easier to understand the structural arrangement for facilitating the mounting of the cartridge 7 into the apparatus main assembly A.

When the cartridge 7 is not in the apparatus main assembly A, the development roller 40 is always kept in contact with the photosensitive drum 1 (FIG. 2). The cartridge 7 is inserted into the apparatus main assembly A in such a manner that the bearings 31L and 31R for supporting the photosensitive drum 1, will fit into the pair of grooves (34*a* and 34*e*, respectively, (in the direction indicated by an arrow mark X in FIG. 3). After the mounting of the cartridge 7 into the apparatus main assembly A, the development roller 40 is separated from the photosensitive drum 1 by the pair of development roller separating members (8Ra–8Rd) and (8La–8Ld) in the form of a cam, which will be described later.

(Development Roller Separating Member)

Here, the development roller separating member (which hereinafter will be referred to simply as "separating members") will be described with reference to the cartridge compartment 100*a*, which is the bottommost cartridge compartment of the apparatus main assembly A. Obviously, the other cartridge compartments 100*b*–100*d* are the same in structure as the cartridge compartment 100*a*.

Referring to FIGS. 4 and 5, the separating member 8Ra is attached to the shaft 8*c* as a supporting shaft which extends from one end of the development unit 4 to the other in terms of the lengthwise direction of the development roller 40, being enabled to rotate about the axial line of the shaft 8*c*. The separating member 8Ra (8La) partially protrudes from the frame 32*c* of the apparatus main assembly A, through a hole 32*f* (32*g*) of the frame 32, making it possible to reduce the distance between the cartridge 7 and frame 32*c*, making it thereby possible to reduce the dimension of the image forming apparatus in terms of the direction in which the cartridge 7 is mounted into the apparatus main assembly A.

The frame 32*c* of the apparatus main assembly A is provided with a hole 32*h* which allows a beam of laser light to be projected into the cartridge 7. The aforementioned holes 32*f* and 32*g* for allowing the separating member 8Ra (8La) to partially protrude from the frame 32 are outside the range of the laser light hole 32*h* in terms of the lengthwise direction of the photosensitive drum 1. With the provision of the above described structural arrangement, the frame 32*c* of the apparatus main assembly A is stronger than that in accordance with the prior art, thereby increasing the strength of the apparatus main assembly A compared to the apparatus main assembly (A) in accordance with the prior art.

In comparison, the developing means frame 45 is provided with a first clearance 45*a*, which allows the separating member 8Ra to overlap with the cartridge 7 in terms of the direction parallel to the lengthwise direction of the photosensitive drum 1. The developing means frame 45 is also provided with a force catching portion 46*e* in the form of a cam follower, with which the separating member 8Ra comes into contact in order to transmit thereto the force for separating the development roller 40 from the photosensitive drum 1. The force catching portion 46*e* projects from one of the lengthwise ends of the developing means frames 45 in terms of the direction parallel to the lengthwise direction of the photosensitive drum 1. It is located on the downstream side of the first clearance 45*a* in terms of the cartridge insertion direction. This structural arrangement makes it possible to increase the amount by which the separating member 8Ra is allowed to enter the first clearance 45*a*, making it thereby possible to reduce the size of the apparatus main assembly A.

Figure 6:
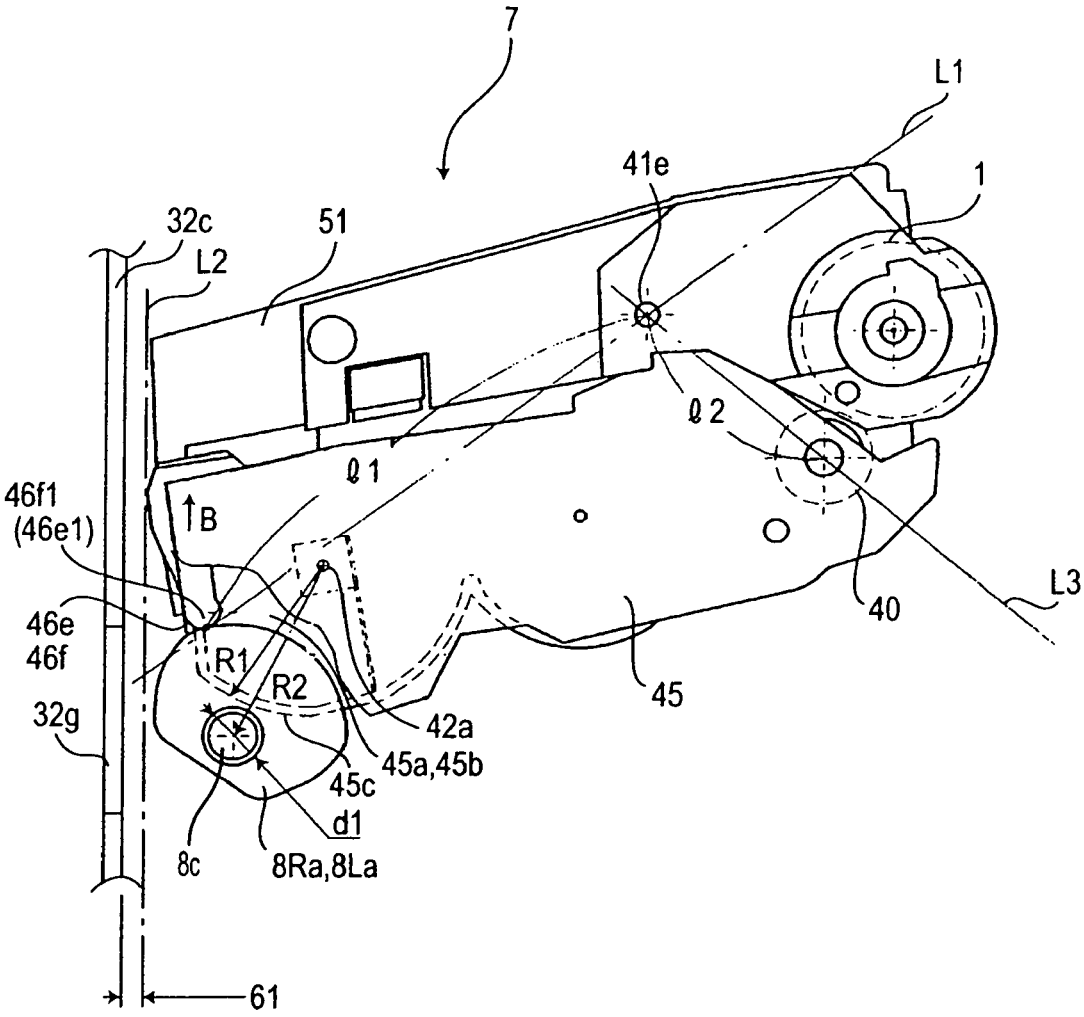
FIG. 6 is a partially phantom side view of the process cartridge in the preferred embodiment of the present invention.

In this embodiment, the separating member 8Ra is in the form of a cam. Normally, it is in the position (second position) in which it does not contact the force catching portion 46*e*. However, as it is rotated about the axial line of the shaft 8*c*, it comes into contact with the force catching portion 46*e*, and as it is further rotated into the first position, it lifts the force catching portion 46*e* in the direction indicated by an arrow mark B, rotating thereby the development unit 4 about the axial line of shaft 41*e*. Referring to FIG. 6, the development roller 40 is on the upstream side of the shaft 41*e* in terms of the cartridge insertion direction, and the force catching portion 46*e* is on the downstream side of the shaft 41*c*, assuring that the development roller 40 is separated from the photosensitive drum 1 by the rotation of the development unit 4 about the axial line of the shaft 41*e*. Although in this embodiment the separating member 8Ra is in the form of a cam, the separating member 8Ra may be in the form of a lever.

As described above, the provision of the first clearance 45*a* allows the cartridge 7 and separating member 8Ra to overlap in the direction parallel to the lengthwise direction of the photosensitive drum 1. In other words, the provision of the first clearance 45*a* allows a minimum of a part of the separating member 8Ra to enter the range of the cartridge 7 in terms of the direction perpendicular to the lengthwise direction of the photosensitive drum 1. Therefore, the provision of the first clearance 45*a* makes it possible to reduce the dimension of the image forming apparatus A in terms of the lengthwise direction of the photosensitive drum 1 as well as the vertical direction, making it thereby possible to reduce the image forming apparatus A in size.

Figure 8:
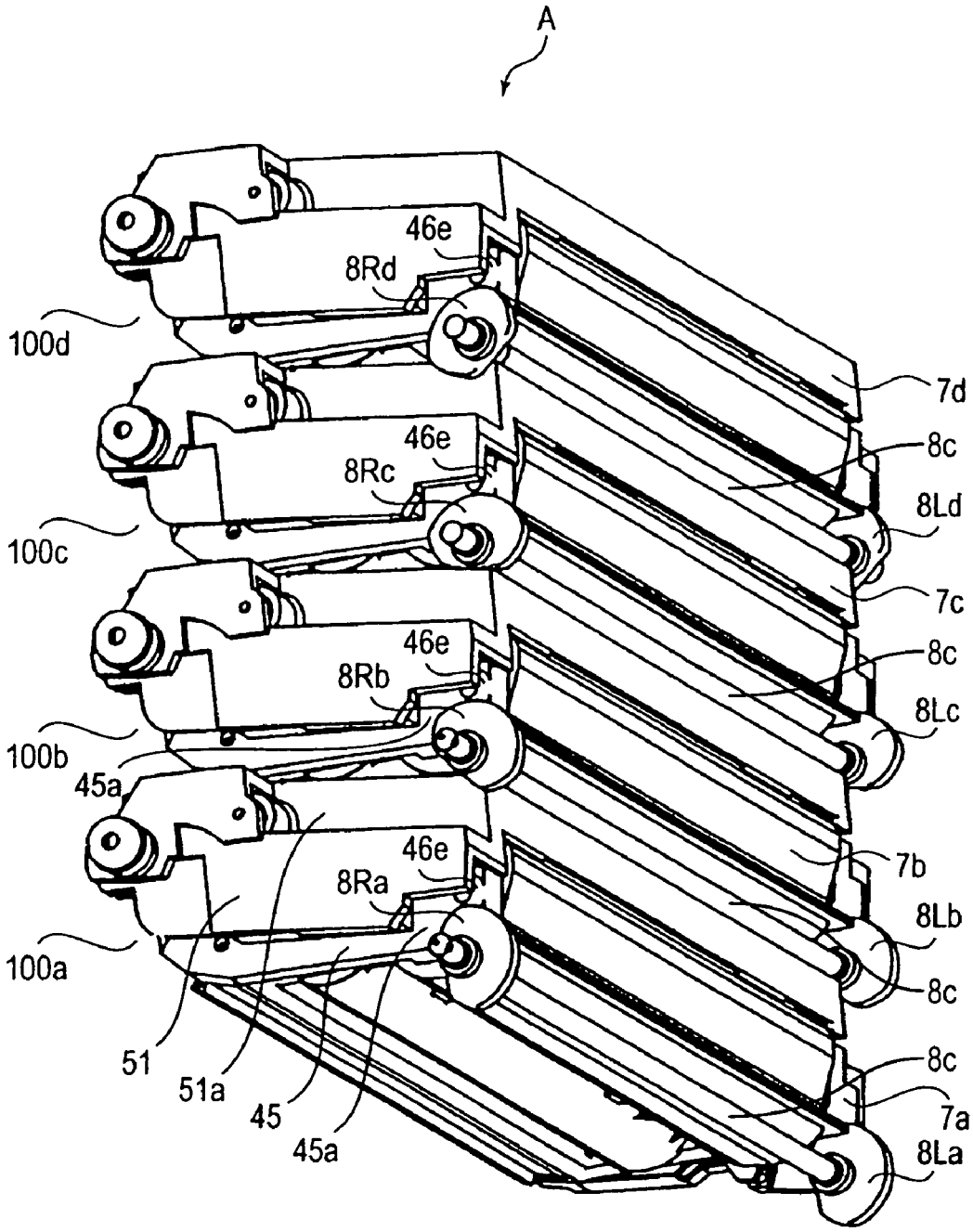
FIG. 8 is a schematic perspective view of the plurality of process cartridges stacked in the apparatus main assembly A, and the plurality of development roller separation mechanisms of the apparatus main assembly A, in the preferred embodiment, showing the structure of the mechanism.

Next, referring to FIG. 8, in the case of the image forming apparatus A in this embodiment, the plurality of cartridges 7 are vertically stacked (stacked in height direction of the image forming apparatus A) at predetermined intervals (only cartridges 7 and separating members 8 are shown in FIG. 8). In other words, the cartridge compartments 100*a*–100*d* are also vertically stacked. Therefore, the cleaning means frame 51 is provided with a third clearance 51*a* for accommodating the separating member 8Rb of the cartridge 7*b* located immediately above the cartridge 7*a*. The clearance 51*a* is located at the lengthwise end (in terms of the direction parallel to lengthwise direction of the photosensitive drum 1). It is the space into which the separating member 8Rb of the cartridge 7*b* located immediately above the cartridge 7*a* is allowed to enter, at least partially. The clearance 51*a* is located at the top of the cartridge 7*a*. The provision of the clearance 45*a* and the third clearance 51*a* makes it possible for the cartridge 7*a* not to interfere with the rotation of the separating means 8Rb of the cartridge 7*b* stacked immediately above the cartridge 7*a*. Thus, the provision of the clearance 51*a* makes it possible to reduce the vertical dimension of an image forming apparatus such as a color image forming apparatus in which a plurality of cartridges are vertically stacked.

In the case of the development roller separation mechanism in this embodiment, the separating member 8Ra is connected to the second separating member 8La also in the form of a cam, with the shaft 8*c* by being attached to one end and the other thereof (FIG. 5). The frame 32*c* is provided with a hole 32*g*, through which the separating member 8La is allowed to project, at least partially, allowing thereby the distance between the cartridge 7*a* and the frame 32*c*, in terms of the cartridge insertion direction, to be reduced. Therefore, the provision of the hole 32*g* allows the size of the image forming apparatus A to be reduced in terms of the cartridge insertion direction. The hole 32*g* is positioned outside the range of the hole 32*h* for the laser beam.

Further, the developing means frame 45 is provided with a second clearance 45*b* (void), like the first clearance 45*a*, which allows the separating member 8La to positioned in a manner to overlap with the cartridge 7*a* in terms of the direction parallel to the lengthwise direction of the photosensitive drum 1. More specifically, the provision of the second clearance 45*b* allows the separating member 8La to overlap with the cartridge 7*a*, at least partially, in terms of the direction parallel to the lengthwise direction of the photosensitive drum 1, making it thereby possible to reduce the size of the image forming apparatus A. The force catching portion 46*f* as the second force catching portion in the form of a cam follower, which transmits the force from the separating member 8La by being placed in contact with the separating member 8La, projects from the developing means frame 45 in the direction parallel to the lengthwise direction of the photosensitive drum 1.

In this embodiment, the separating member 8La is in the form of a cam. Normally, it is placed in the position (second position) in which it is not allowed to contact the force catching portion 46*f*. It rotates with the separating member 8Ra about the axial line of the shaft 8*c*. Thus, as the shaft 8*c* is rotated, the separating member 8La is rotated along with the separating member 8Ra, coming into contact with the force catching portion 46*f* as the separating member 8Ra comes into contact with the force catching portion 46*e*. Thus, as the shaft 8*c* is further rotated, not only is the force catching portion 46*e* lifted but also the force catching portion 46*f* is lifted, while pivoting the development unit 4 about the axial line of the shaft 41*e*, in the direction indicated by the arrow mark B, into the positions (first position) in which they keep the development roller 40 separated from the photosensitive drum 1. The positional relationship between the force catching portion 46*f* and second clearance 45*b*, and the positional relationship among the force catching portion 46*f*, the shaft 41*e*, and the development roller 40, are the same as the positional relationship among those on the other side of the cartridge 7*a* in terms of the direction parallel to the lengthwise direction of the photosensitive drum 1.

Since the cartridge 7*a* is provided with the pair of force catching portions 46*e* and 46*f*, which are located at the ends of the cartridge 7, one for one, in terms of the direction parallel to the lengthwise direction of the photosensitive drum 1, it is assured that the development roller 40 is precisely separated from the photosensitive drum 1.

Figure 9:
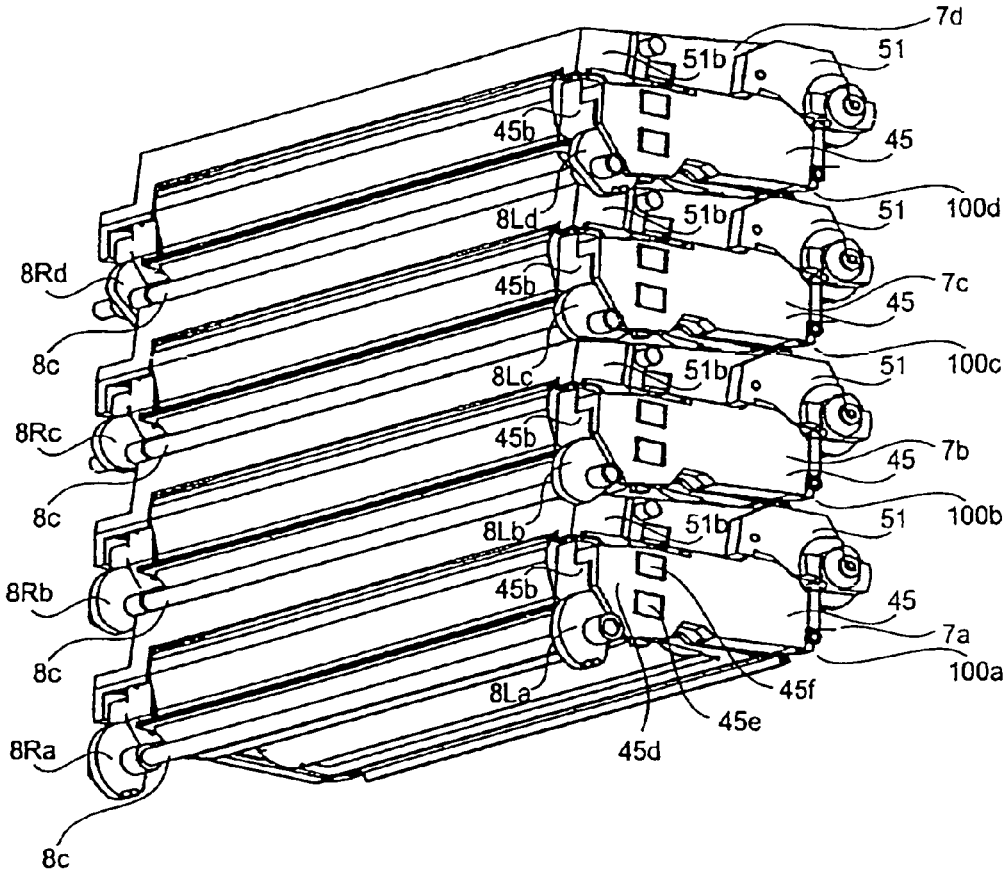
FIG. 9 is a schematic perspective view of the plurality or process cartridges stacked in the apparatus main assembly A, and the plurality of development roller separation mechanisms of the apparatus main assembly A, in the preferred embodiment, showing the structure of the mechanism.

Next, referring to FIG. 9, the development means frame 45 is provided with a pair of development bias contacts (45*e* and 45*f*) for applying developing bias to the development roller 40. The pair of development bias contacts (45*e* and 45*f*) are exposed at the external surface of the side wall of the frame 45, on the opposite of the frame 45 from the separating member 8Ra, and are to come into contact with the development bias contacts (unshown) on the main assembly side of the image forming apparatus A, as the cartridge 7 is mounted into the apparatus main assembly A. In terms of the direction parallel to the aforementioned lengthwise direction, the development bias contacts (45*e* and 45*f*) are positioned outward of the second clearance 45*b*. This structural arrangement can also contribute to the reduction of the dimension of the apparatus main assembly A in terms of the direction parallel to the lengthwise direction, being thereby capable of contributing to the size reduction of the apparatus main assembly A.

Also referring to FIG. 9, in the case of the image forming apparatus A in this embodiment, the plurality of cartridges 7 are vertically stacked (stacked in the height direction of image forming apparatus A) at predetermined intervals (only cartridges 7 and separating members 8 are shown in FIG. 9). Thus, the cleaning means frame 51 of each cartridge 7 (7*a*) is provided with a fourth clearance 51*b* (void), which is located at the opposite end of the cleaning means frame 51 from the separating member 8La in terms of the direction parallel to the lengthwise direction of the photosensitive drum 1, and which allows the separating member 8Lb of the cartridge 7*b* located immediately above the cartridge 7*a* to enter, at least partially, the range of the cartridge 7*a* in terms of the vertical direction, allowing thereby the separating member 8Lb to overlap with the cartridge 7 in terms of the direction parallel to the lengthwise direction of the photosensitive drum 1. With the provision of this fourth clearance 51*b* along with the first clearance 45*a*, the separating member 8Lb is allowed to enter, at least partially, the clearance 45*a* of a given cartridge 7*a* and the clearance 51*b* of the cartridge 7*b* immediately below the given cartridge 7 (7*a*), making it possible to position the separating member 8 in such a manner that the separating member 8 overlaps with the adjacent two cartridges 7. Therefore, it is possible to reduce in vertical dimension an image forming apparatus, such as a color image forming apparatus, in which a plurality of force catching portions 46*e*, 46*f*, by which a developing means frame 45 is lifted by a development roller separating member 8, are vertically stacked.

Next, referring to FIGS. 6 and 7, the positioning of the separating member relative to the cartridge 7 will be described. FIG. 6 is a partially phantom side view of the process cartridge in this embodiment, and FIG. 7 is a schematic drawing showing the positional relationship between the process cartridge and separating member, in terms of the direction parallel to the lengthwise direction of the photosensitive drum 1.

Figure 7:
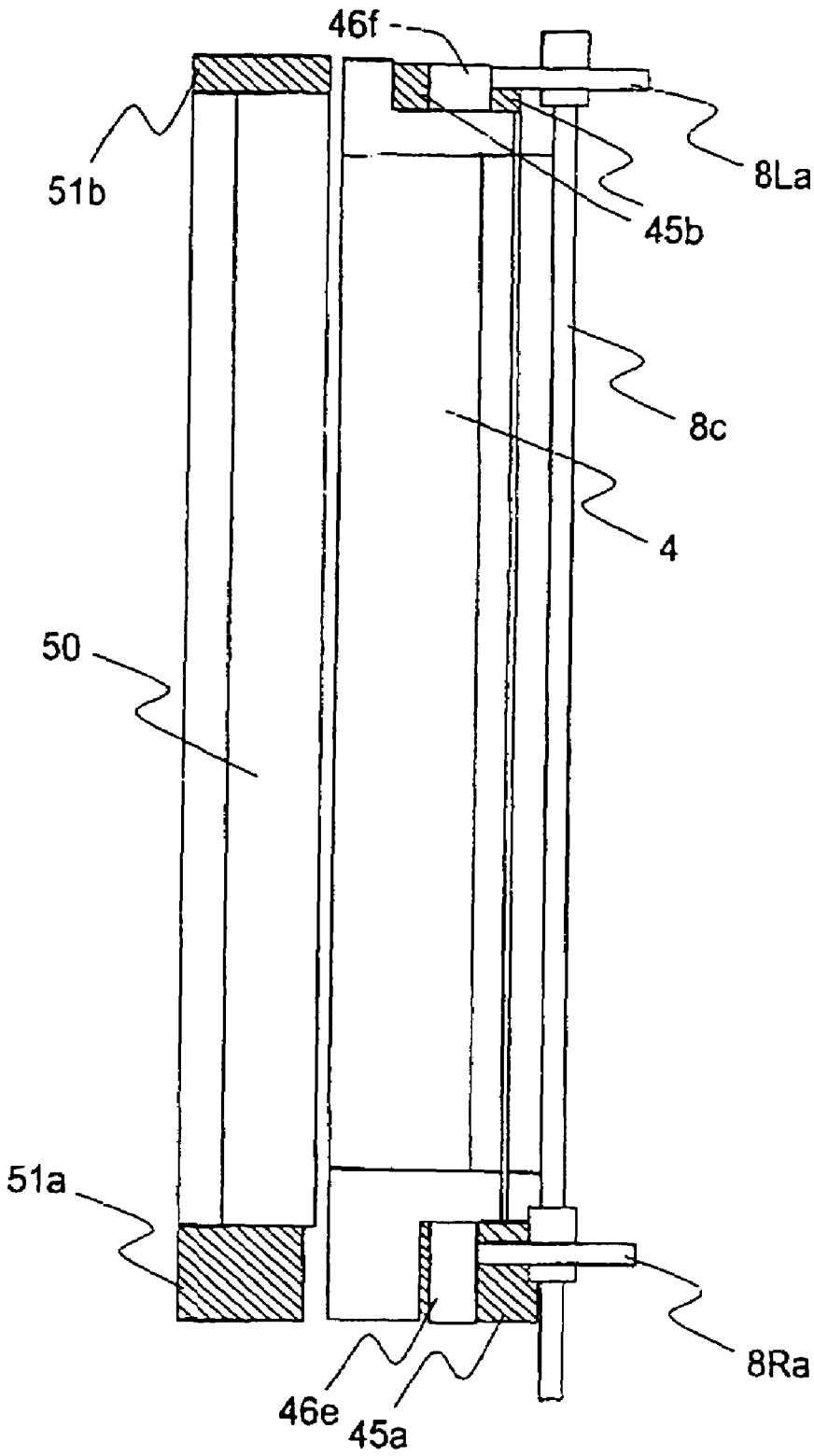
FIG. 7 is a schematic drawing of the process cartridge and development roller separation mechanism, showing their positional relationship in terms of the lengthwise direction of the photosensitive drum.

Referring to FIGS. 6 and 7, the separating members 8Ra and 8La are rotated about the axial line of the shaft 8*c* by the shaft 8*c*. As the separating members 8Ra and 8La are rotated, the force catching portions 46*e* and 46*f* are pushed by the separating members 8Ra and 8La in the direction indicated by the arrow mark B, causing thereby the development unit 4 to rotate about the shaft 41*c*. As a result, the development roller 40 is separated from the photosensitive drum 1. Providing the frame 32*c* of the apparatus main assembly A with the holes 32*f* and 32*g*, and positioning the separating members 8Ra and 8La so that when they are rotated, they are allowed to partially project outward through the holes 32*f* and 32*g*, respectively, as described above, make it possible to reduce the gap 61 necessary, between the leading end (L2) of the developing means frame 45, in terms of the cartridge insertion direction, and the frame 32*c*, in order to accommodate the separating members 8Ra and 8La.

Further, the shaft 8*c* is positioned so that its rotational axis will be below the lines L1 connecting the ends of the axial lines of the shaft 41*e* and the force catching portions 46*e* and 46*f*, one for one, when the cartridge 7*a* is in the apparatus main assembly A. This structural arrangement makes it possible for the force catching portions 46*e* and 46*f* to efficiently receive the force applied by the separating members 8Ra and 8La in the arrow B direction.

Further, the shaft 8*c* is positioned so that its rotational axis will be upstream of the edge L2 of the developing means frame 45, in terms of the cartridge insertion direction, and below the arcuate bottom front end portion 45*c* of the developing means frame 45 in terms of the cartridge insertion direction. Positioning the shaft 8*c* as described above makes it possible to reduce the distance between the adjacent two cartridges 7, making it thereby possible to reduce the size of the apparatus main assembly A.

Positioning the shaft 8*c* as described above also makes it possible to reduce the aforementioned gap 61, making it thereby possible to reduce the dimension of the apparatus main assembly A in terms of the cartridge insertion direction. Incidentally, the curvature (R) of the bottom front end portion 45*c* is determined by the rotational radius of the developer conveyance mechanism 42. In this embodiment, when R1 stands for the distance from the rotational axis 42*a* of the developer conveyance mechanism 42 to the external surface of the bottom front end portion 45*c* of the developing means frame 45, which corresponds to the curvature (R) of the bottom front portion 45*c*; R2 stands for the distance from the rotational axis 42*a* of the developer conveyance mechanism 42 to the center of the shaft 8*c*; and d1 stands for the diameter of the shaft 8*c*, the shaft 8*c* has only to be positioned so that the following inequality is satisfied: R2>R1+d1/2.

Further, in this embodiment, the bottom front end portion 45*c* of the developing means frame 45 is arcuate. However, it does not need to be arcuate. In other words, it has only to be shaped so that it does not interfere with the shaft 8*c*. For example, it may be simply flat and tilted.

Also in this embodiment, the distance $l_1$ from the axial line of the shaft 41*e* to the point 46*e*1 is (46*f*1) of the force catching portion 46*e* (46*f*), at which the force catching portion 46*e* (46*f*) receives the force from the separating member 8Ra (8La), is made greater than the distance $l_1$ from the axial line of the shaft 41*e* to the rotational axis of the development roller 40, reducing thereby the amount of the force necessary to lift the second frame 45 (developing means frame 45) in the arrow B direction by the separating members 8Ra and 8La. Therefore, a smaller motor can be employed as the mechanical power source (unshown) from which driving force is transmitted to the separating members 8Ra and 8La, making it possible to reduce the size of the apparatus main assembly A.

As will be evident from the above description, this embodiment makes it unnecessary for a dedicated space for the pair of separating members to be provided between the cartridge 7 and the frame 32*c* of the image forming apparatus main assembly A. Therefore, this embodiment makes it possible to reduce the image forming apparatus main assembly A in size.

In the case of this embodiment, the only modification which must be made when enlarging the toner container in order to prolong the service life of the cartridge 7 is to enlarge the above-mentioned first and second clearances 45*a* and 45*b* of the developing means frame 45, because enlarging the first and second clearances 45*a* and 45*b* makes it unnecessary to increase the size of the image forming apparatus main assembly even if the separating members 8Ra and 8La are increased in size to lift the force catching portions 46*e* and 46*f* in order to pivot the toner container of the increased size.

Also in this embodiment, the force catching portions 46*e* and 46*f* are positioned at the ends of the developing means frame 45 in the lengthwise direction (parallel to the lengthwise direction of photosensitive drum 1). Therefore, the deformation of the developer conveyance mechanism, which will occur due to the interference between the force catching portions 46*e* and 46*f* and developer conveyance mechanism if the force catching portions 46*e* and 46*f* are located, for example, at the center portion in terms of the lengthwise direction of the toner container 41 shown in FIG. 2, does not occur. Further, the above described positioning of the force catching portions 46*e* and 46*f* does not cause the toner in the adjacencies of the clearances 45*a* and 45*b* to be unsatisfactorily stirred. Therefore, the problem that the portions of an image corresponding, in location, to the clearances 45*a* and 45*b* are defectively formed does not occur.

The holes 32*f* and 32*g* are located outside the ranger of the laser beam window 32*h*, in terms of the lengthwise direction of the photosensitive drum 1. Therefore, the frame of the process cartridge in this embodiment is stronger than the frame or a process cartridge having the clearances in the center portions thereof.

Further, the force catching portions 46*e* and 46*f* are located at the ends of the developing means frame 45, one for one, in terms of the lengthwise direction (parallel to the lengthwise direction of the photosensitive drum 1). Therefore, the amount by which the cartridge 7 deforms as the force catching portions 46*e* and 46*f* receive the force from the separating members 8Ra and 8La is smaller, because the lengthwise end portions of the developing means frame 45 and the cleaning means frame 51, which are the side walls thereof, are reinforced to support a substantial number of gears and supporting members, being therefore stronger. Further, so positioning the force catching portions 46*e* and 46*f* makes it less likely for them be affected by the warping of the molded components. Therefore, the size of the force receiving portions 46*e* and 46*f* remains stable. In other words, placing the forces catching portions 46*e* and 46*f* at the ends of the developing means frame 45, one for one, can prevent the force catching portions 46*e* and 46*f* from changing their dimensions. Thus, this arrangement allows the distance by which the developing means frame 45 needs to be moved to assure the separation of the development roller 40 from the photosensitive drum 1, to be reduced. Therefore, it can improve the process cartridge in terms of the levels of preciseness and speed at which the development roller 40 is separated from the photosensitive drum 1.

Figure 10:
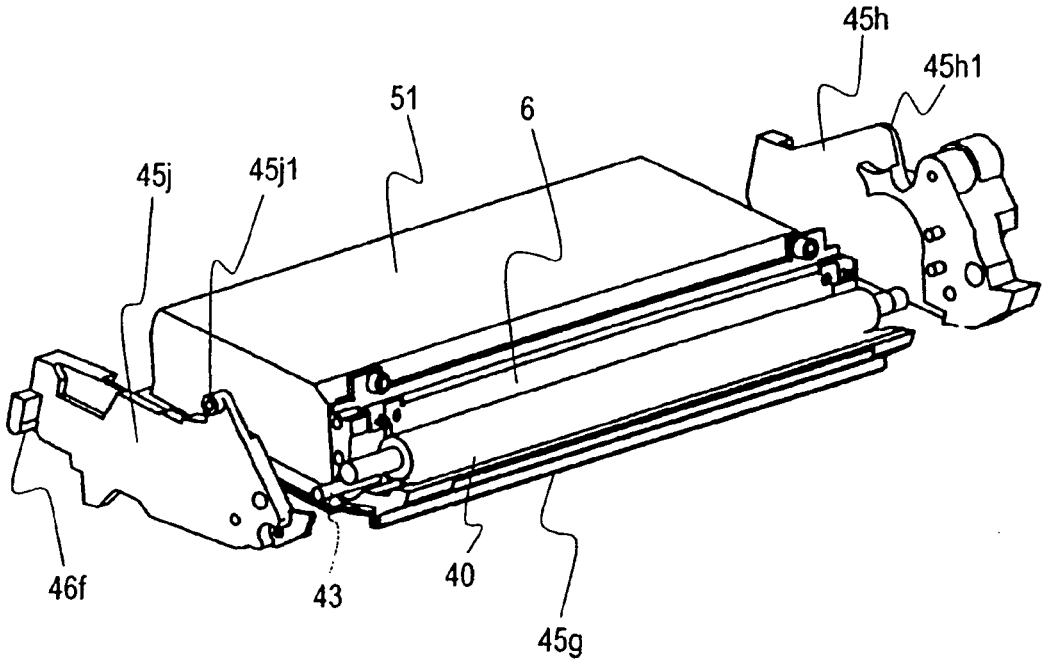
FIG. 10 is a schematic perspective view of the second frame in the preferred embodiment or the present invention.

Referring to FIG. 10, the developing means frame 45 essentially comprises three sections: the blade supporting sub-frame 45*g*, the first side wall 45*h*, and the second side wall 45*j*. The blade supporting subframe 45*g* is for supporting the development blade 45, and the first and second side walls 45*h* and 45*j* are for rotationally supporting the development roller 40 and the toner conveyance roller 43. The first and second side walls 45*h* and 45*j* also support the gears (unshown) for transmitting a driving force to the development roller 40 and the toner conveyance roller 43. The force catching portions 46*e* and 46*f* are attached to the first and the second side walls 45*h* and 45*j*, respectively. The first side wall 45*h* is provided with a support 45*h*1, into which the shaft (unshown) is inserted to be rotationally supported by the first side wall 45*h* and the cleaning means frame 51. Similarly, the second side wall 45*j* is provided with a support 45*j*1, into which the shaft (unshown) is inserted to be rotationally supported by the second side wall 45*j* and the cleaning means frame 51.

With the provision of the above described structural arrangement, it is assured that the development roller 40, the axis of the shaft 41*e* (the axis about which development roller 40 pivots), and the force catching portions 46*e* and 46*f* are precisely positioned relative to each other. Therefore, the tolerance in the distance between the peripheral surfaces of the photosensitive drum 1 and the development roller 40 becomes smaller, allowing the distance by which the developing means frame 45 needs to be moved to separate the development roller 40 from the photosensitive drum 1, to be reduced. Therefore, not only is it possible to improve the process cartridge 7 in its responsiveness in the operation for separating the development roller 40 from the photosensitive drum 1, but also, it is possible to improve the image forming apparatus main assembly A in operational speed.

Further, in this embodiment, the clearance 45*a* (first clearance) is the space surrounding a first horizontal plane which includes the lowest point of the second frame 45 (either the developing means frame or the developer container, or both), and a second horizontal plane which includes the highest point of the second frame 45, a first vertical plane which includes the most downstream point of the second frame 45 in terms of the cartridge insertion direction, and a second vertical plane which includes the outermost point of the second frame 45 in terms of the lengthwise direction, and in which at least a part of the cam 8Ra is allowed to enter, when the cartridge 7 is mounted into the apparatus main assembly A.

Similarly, the clearance 45*b* (second clearance) is the space surrounding a first horizontal plane which includes the lowest point of the second frame 45 (either the developing means frame or the developer container, or both), and the second horizontal plane which includes the highest point of the second frame 45, the first vertical plane which includes the most downstream point of the second frame 45 in terms of the cartridge insertion direction, and the second vertical plane which includes the outermost point of the second frame 45 in terms of the lengthwise direction, and in which at least a part of the cam 8La is allowed to enter, when the cartridge 7 is mounted into the apparatus main assembly A.

Further, the clearance 51*a* (third clearance) is the space which is surrounded by the first horizontal plane which includes the lowest point of the cartridge 7, and the second horizontal plane which includes the highest point of the cartridge 7, the first vertical plane which includes the most downstream point of the cartridge 7 in terms of the cartridge insertion direction, and the second vertical plane which includes the outermost point of the cartridge 7 in terms of the lengthwise direction, and in which at least a part of the cam 8Rb is allowed to enter, when the cartridge 7 is mounted into the apparatus main assembly A.

Similarly, the clearance 51*b* (fourth clearance) is the space which is surrounded by the first horizontal plane which includes the lowest point of the cartridge 7, and the second horizontal plane which includes the highest point of the cartridge 7, the first vertical plane which includes the most downstream point of the cartridge 7 in terms of the cartridge insertion direction, and the second vertical plane which includes the outermost point of the cartridge 7 in terms of the lengthwise direction, and in which at least a part of the cam 8Lb is allowed to enter, when the cartridge 7 is mounted into the apparatus main assembly A.

Next, referring to FIG. 11, an aspect of the process cartridge 7 in this embodiment will be described.

The process cartridge of this embodiment is detachably mountable to a main assembly of an electrophotographic image forming apparatus, and includes a frame; a photosensitive member provided in the frame; an upper recess (X) formed in the frame and provided at an end portion with respect to a longitudinal direction of said photosensitive drum, the upper recess being disposed at an upper position when the process cartridge is set in the main assembly of the apparatus, and the recess recessing longitudinally inwardly and opening at its upper portion and at its leading portion which takes a leading position when the process cartridge is mounted to the main assembly of the apparatus; a lower recess (Y) formed in the frame and provided at an end portion with respect to the longitudinal direction of the photosensitive drum, the lower recess being disposed at an lower position when the process cartridge is set in the main assembly of the apparatus, and the recess recessing longitudinally inwardly and opening at its lower portion and at its leading portion which takes the leading position when the process cartridge is mounted to the main assembly of the apparatus, wherein the lower recess (Y) and a phantom upper recess (X') which is provided by displacing the upper recess (X) in a predetermined direction (Z) through a predetermined distance beyond the lower recess (Y) constitutes a synthesized recess having a size and shape for receiving a member (8Rd) which is provided in the main assembly and which is actable on the process cartridge.

The member may be a cam member actable on the process cartridge. The cam may be rotatable.

The predetermined direction may be inclined by a predetermined angle from a vertical line. The predetermined distance is larger than a substantial maximum height of the process cartridge by a predetermined height.

The recess may be provided at both of the longitudinal end portions of the frame.

More particularly, the cartridge 7 in this embodiment is such a cartridge that as it is mounted in a given cartridge compartment of the apparatus main assembly A, a recess or space (clearance) in which the cam (8Rd, 8Ld) is allowed to enter, will be left between the cartridge in the given cartridge compartment and the cartridges in the adjacent two cartridge compartments. The details of this characteristic aspect of the process cartridge structure in accordance the present invention are as follows.

Figure 11:
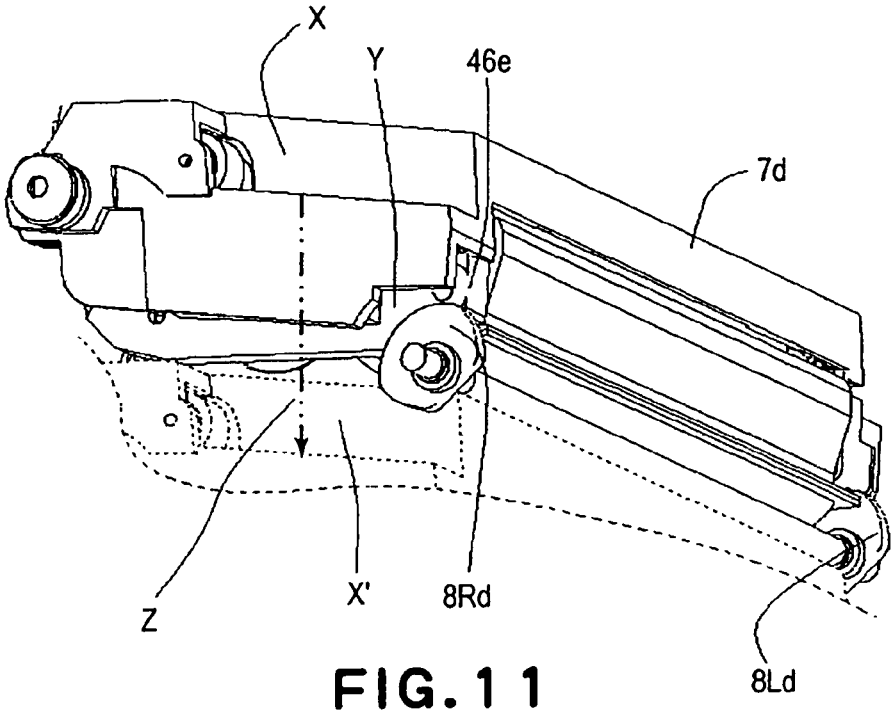
FIG. 11 is a perspective view of the process cartridge and development roller separation mechanism in the preferred embodiment of the present invention.

Referring to FIG. 11, the cartridge 7 has a pair of top clearances X which are created by slightly reducing the dimension of the top front end portion of the cleaning means frame 51 in terms of its lengthwise direction of the cartridge 7. The pair of top clearances X are configured so that when the cartridge 7 is in the apparatus main assembly A, they are clear on the top side, and also, on the front side in terms of the cartridge insertion direction. The cartridge 7 also has a pair of bottom recesses or clearances Y which are created by slightly reducing the dimension of the bottom front end portion of the developing means frame 45 in terms of the lengthwise direction of the cartridge 7. The pair of bottom clearances Y are configured so that when the cartridge 7 is in the apparatus main assembly A, they are clear on the bottom side and also, on the front side in terms of the cartridge insertion direction. Although the top clearance X and the bottom clearance Y are different in location, they have the following organic relationship.

That is, in FIG. 11, X' stands for the top recess of the phantom cartridge 7*d*' created by hypothetically moving the cartridge 7*d* having the top recess X in a predetermined direction (the direction in which multiple cartridges are stacked, which in this embodiment is roughly 10°. relative to vertical direction) (indicated by an arrow mark Z) by a predetermined distance. As will be evident from the drawing, there is formed a partly phantom recess (Y+X'), or an actual recess Y of the cartridge 7*d* and the phantom recess X' of the theoretical cartridge 7*d*, between the cartridge 7*d* and phantom cartridge 7*d*'. This partly phantom recess (Y+X') is vacant on the front side in terms of the direction in which the cartridge 7 is inserted into the image forming apparatus main assembly A, and is large enough, and shaped, to allow the abovementioned cam (8Rd, 8Ld) to enter it, and to rotate therein.

Here, the above-mentioned predetermined distance equals the distance between the adjacent two process cartridge 7 (7*a*, 7*b*, 7*c*, and 7*d*) (in terms of the aforementioned direction in which they are stacked) when multiple cartridges (7*a*, 7*b*, 7*c*, and 7*d*) are mounted in the image forming apparatus main assembly A. However, when the adjacent two cartridges 7 (7*a*, 7*b*, 7*c*, and 7*d*) do not engage with each other when they are set in the main assembly of the apparatus, the predetermined distance is greater than the maximum dimension (in terms of aforementioned direction in which multiple cartridges are stacked), preferably by a predetermined dimension.

Each of the multiple cartridges to be mounted in the image forming apparatus main assembly A is provided with the top recesses X and bottom recesses Y shaped and positioned as described above. Therefore, when multiple cartridges 7 (7*a*, 7*b*, 7*c*, and 7*d*) are vertically stacked in the main assembly A, they do not interfere with the cam (8Rd, 8Ld) action, making it thereby possible to reduce the distance between the adjacent two cartridges 7.

Although in this embodiment, it is at both or the lengthwise ends of the process cartridge 7 that the recesses X and Y are located, it may be at only one of the lengthwise ends or the process cartridge, as long as the cam action is not adversely affected.

Also in this embodiment, it is the cam (8Rd, 8Ld) that is allowed to enter the recesses. However, this embodiment is not intended to limit the scope of the present invention. For example, the effects of the present invention can be realized with the employment of such a member as a lever that can be vertically moved.

The preceding embodiment of thee present invention was described with reference to the bottommost cartridge among the four process cartridge 7 mounted in the main assembly A of the image forming apparatus. The process cartridges other than the bottommost one are the same in structural arrangement as the bottommost one.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, the image forming apparatus including a first cam member movable between a first position and a second position away from the first position, said process cartridge comprising:

an electrophotographic photosensitive drum;

a developing roller, contacting said electrophotographic photosensitive drum, configured and positioned to develop an electrostatic latent image formed on said electrophotographic photosensitive drum;

a first frame configured and positioned to support said electrophotographic photosensitive drum;

a second frame configured and positioned to support said developing roller, said second frame being connected with said first frame for relative rotation about a shaft which is disposed downstream of said developing roller with respect to a mounting direction in which said process cartridge is mounted to a main assembly of the apparatus;

a first entering portion, provided at one end portion of said second frame with respect to a longitudinal direction of said electrophotographic photosensitive drum and disposed downstream of the shaft with respect to the mounting direction, configured and positioned to permit at least a part of the first cam member with respect to the longitudinal direction to enter said process cartridge when said process cartridge is mounted to the main assembly of the apparatus; and a first cam engaging portion configured and positioned to engage the first cam member to receive from the first cam member a force for spacing said electrophotographic photosensitive drum and said developing roller from each other, said first cam engaging portion being disposed at said one end portion of said second frame and downstream of said first entering portion with respect to the mounting direction.

2. A process cartridge according to claim 1, wherein the distance between the portion of said first cam engaging portion that receives the force and the center of the shaft is longer than the distance between the center of the shaft and the center of rotation of said developing roller.

3. A process cartridge according to claim 1 or 2, further comprising:

a second entering portion, provided at the other end portion of said second frame with respect to the longitudinal direction of said electrophotographic photosensitive drum and disposed downstream of the shaft with respect to the mounting direction, configured and positioned to permit at least a part of a second cam member provided in the main assembly of the apparatus with respect to the longitudinal direction to enter said process cartridge when said process cartridge is mounted to the main assembly of the apparatus; and a second cam engaging portion configured and positioned to engage the second cam member to receive from the second cam member a force for spacing said electrophotographic photosensitive drum and said developing roller from each other, said second cam engaging portion being disposed at the other end portion of said second frame and downstream of said second entering portion with respect to the mounting direction.

4. A process cartridge according to claim 1, wherein a line connecting the center of the shaft and the portion of said first cam engaging portion that receives the force from the first cam member is above the center of rotation of the first cam member when said process cartridge is set in the main assembly of the apparatus.

5. A process cartridge according to claim 3, wherein a line connecting the center of the shaft and the portion of said second cam engaging portion which receives the force from the second cam member is above the center of rotation of the second cam member when said process cartridge is set in the main assembly of the apparatus.

6. A process cartridge according to claim 1, further comprising:

a developing bias contact, provided on an end surface of said second frame with respect to the longitudinal direction of said electrophotographic photosensitive drum, configured and positioned to contact a main assembly developing bias contact provided in the main assembly of the apparatus to receive a developing bias voltage from the main assembly of the apparatus, wherein said developing bias contact is disposed outside said first entering portion with respect to the longitudinal direction.

7. A process cartridge according to claim 3, wherein the main assembly of the electrophotographic image forming apparatus further includes a supporting shaft, supported by the main assembly at one and the other end portions thereof with respect to the longitudinal direction, configured and positioned to support the first cam member and the second cam member, the first cam member and the second cam member being rotatable about an axis of the supporting shaft.

8. A process cartridge according to claim 7, wherein said second frame has a developer accommodating container configured and positioned to accommodate a developer for developing said electrostatic latent image, wherein said developer accommodating container permits passage of the supporting shaft in the longitudinal direction at a downstream portion of said process cartridge with respect to the mounting direction.

9. A process cartridge according to claim 1, wherein the electrophotographic image forming apparatus is a color electrophotographic image forming apparatus to which a plurality of said process cartridges are mountable at vertically different positions, and wherein said process cartridge further comprises:

a second entering portion, provided at an upper portion of said process cartridge at said one end portion of said second frame, configured and positioned to permit at least a part of a second cam member provided in the main assembly of the apparatus with respect to the longitudinal direction to enter said process cartridge when said process cartridge is mounted to the main assembly of the apparatus, and wherein the second cam member is effective to cause another electrophotographic photosensitive drum, which is provided in another process cartridge disposed above said process cartridge, and another developing roller, which is provided in the another process cartridge, to be spaced relative to each other and to contact each other, wherein the another developing roller contacts the another electrophotographic photosensitive drum to develop an electrostatic latent image formed on the another electrophotographic photosensitive drum.

10. A process cartridge according to claim 9, wherein said process cartridge further comprises:

a third entering portion, provided at an upper portion of said process cartridge at the other end portion of said second frame, configured and positioned to permit at least a part of a third cam member provided in the main assembly of the apparatus with respect to the longitudinal direction to enter said process cartridge when said process cartridge is mounted to the main assembly of the apparatus, and wherein the third cam member is effective to cause the another electrophotographic photosensitive drum and the another developing roller to be spaced relative to each other and to contact each other.

11. An electrophotographic image forming apparatus for forming an image on a recording material, to which a process cartridge is detachably mountable, said apparatus comprising:

(i) a first cam member movable between a first position and a second position away from the first position;

(ii) mounting means for detachably mounting the process cartridge, the process cartridge including:

an electrophotographic photosensitive drum, a developing roller, contacting the electrophotographic photosensitive drum, configured and positioned to develop an electrostatic latent image formed on the electrophotographic photosensitive drum, a first frame configured and positioned to support the electrophotographic photosensitive drum, a second frame configured and positioned to support the developing roller, the second frame being connected with the first frame for relative rotation about a shaft which is disposed downstream of the developing roller with respect to a mounting direction in which the process cartridge is mounted to a main assembly of said apparatus, a first entering portion, provided at one end portion of the second frame with respect to a longitudinal direction of the electrophotographic photosensitive drum and disposed downstream of the shaft with respect to the mounting direction, configured and positioned to permit at least a part of said first cam member with respect to the longitudinal direction to enter the process cartridge when the process cartridge is mounted to the main assembly of said apparatus; and a first cam engaging portion configured and positioned to engage said first cam member to receive from said first cam member a force for spacing the electrophotographic photosensitive drum and the developing roller from each other, the first cam engaging portion being disposed at the one end portion of the second frame and downstream of the first entering portion with respect to the mounting direction;

(iii) means for forming an image on the recording material when the process cartridge is mounted to the main assembly of said apparatus; and (iv) feeding means for feeding the recording material.

12. An apparatus according to claim 11, further comprising:

a second cam member movable between a first position and a second position away from the first position, wherein at least a part of said second cam member enters a second entering portion which is provided at the other end portion of the second frame with respect to the longitudinal direction of the electrophotographic photosensitive drum when the process cartridge is set in the main assembly of said electrophotographic image forming apparatus, and wherein when said second cam member takes the first position, said second cam member contacts a second cam engaging portion provided at the other end portion of the second frame with respect to the main assembly to apply to the second frame a force for spacing the electrophotographic photosensitive drum and the developing roller from each other.

13. An apparatus according to claim 11, wherein said first cam member is rotatably mounted on the main assembly of said electrophotographic image forming apparatus, and wherein the center of rotation of said first cam member is below a line connecting the center of the shaft and the portion of the first cam engaging portion that receives the force from said first cam member when the process cartridge is set in the main assembly of said electrophotographic image forming apparatus.

14. An apparatus according to claim 13, wherein at least the center of rotation of said first cam member is disposed upstream of a downstream end of the second frame with respect to the mounting direction when the process cartridge is set in the main assembly of said electrophotographic image forming apparatus.

15. An apparatus according to claim 12, wherein said second cam member is rotatably mounted on the main assembly of said electrophotographic image forming apparatus, and wherein the center of rotation of said second cam member is below a line connecting the center of the shaft and the portion of said second cam engaging portion that receives the force from said second cam member when the process cartridge is set in the main assembly of said electrophotographic image forming apparatus.

16. An apparatus according to claim 15, wherein at least the center of rotation of said second cam member is disposed upstream of a downstream end of the second frame with respect to the mounting direction when the process cartridge is set in the main assembly of said electrophotographic image forming apparatus.

17. An apparatus according to claim 12, further comprising: a supporting shaft, supported by the main assembly at one and the other end portions thereof with respect to the longitudinal direction, configured and positioned to support said first cam member and said second cam member, said first cam member and said second cam member being rotatable about an axis of said supporting shaft.

18. An apparatus according to claim 17, wherein said supporting shaft is disposed below a line connecting the center of the shaft and the portion of the first cam engaging portion that receives the force from said first cam member and upstream of a downstream end of the second frame with respect to mounting direction and below the second frame, when the process cartridge is set in the main assembly of said electrophotographic image forming apparatus.

19. A process cartridge detachably mountable to a main assembly of an electrophotographic image forming apparatus, said process cartridge comprising:

a frame; and a photosensitive member provided in said frame, wherein said frame includes an upper recess provided at an end portion of said frame with respect to the longitudinal direction of said photosensitive member, said upper recess facing upward when said process cartridge is set in the main assembly of the apparatus, and said upper recess recessing longitudinally inward and opening at its upper portion and at its leading portion that takes a leading position when said process cartridge is mounted to the main assembly of the apparatus, wherein said frame also includes a lower recess provided at an end portion of said frame with respect to the longitudinal direction of said photosensitive member, said lower recess facing downward when said process cartridge is set in the main assembly of the apparatus, and said lower recess recessing longitudinally inward and opening at its lower portion and at its leading portion that takes the leading position when said process cartridge is mounted to the main assembly of the apparatus, wherein said lower recess and a phantom upper recess, formed by an upper recess of another process cartridge positioned below said process cartridge in a predetermined direction and spaced from the process cartridge by a predetermined distance, comprises a synthesized recess having a size and shape for receiving a member which is provided in the main assembly and which is actable on said process cartridge.

20. A process cartridge according to claim 19, wherein the member which is provided in the main assembly and which is actable on said process cartridge is a cam member actable on said process cartridge.

21. A process cartridge according to claim 19 or 20, wherein the member which is provided in the main assembly and which is actable on said process cartridge is rotatable.

22. A process cartridge according to claim 19 or 20, wherein the predetermined direction is inclined by a predetermined angle from a vertical line.

23. A process cartridge according to claim 19 or 20, wherein the predetermined distance is substantially larger than the maximum height of said process cartridge by a predetermined distance.

* * * * *

UNITED STATES PATENT AND TRADEMARK OFFICE

CERTIFICATE OF CORRECTION

PATENT NO. : 7,058,337 B2
APPLICATION NO. : 10/840263
DATED : June 6, 2006
INVENTOR(S) : Koji Hashimoto et al.

It is certified that error appears in the above-identified patent and that said Letters Patent is hereby corrected as shown below:

COLUMN 1:
Line 46, “are,” should read --are--.

COLUMN 2:
Line 6, “it” should read --there--.
Line 37, “electrophotographic:” should read --electrophotographic--.

COLUMN 3:
Line 4, “frame,” should read --first frame,--.
Line 41, “term” should read --terms--.
Line 51, “once” should read --one--.

COLUMN 4:
Line 22, “then” should read --the--.
Line 48, “or” should read --of--.

COLUMN 5:
Line 15, “electrophotographic:” should read --electrophotographic--.

COLUMN 6:
Line 3, “entirely” should read --entirety--.
Line 54, “is opposes tie” should read --opposes the--.

COLUMN 7:
Line 3, “drum 1a-1d” should read --drums 1a-1d--.
Line 30, “roller 19,” should read --rollers 19,--.

COLUMN 8:
Line 50, “by is” should read --by--.

COLUMN 9:
Line 35, “3)” should read --3))--.
Line 45, “bers” should read --ber--.

COLUMN 11:
Line 41, “to positioned” should read --to be positioned--.

COLUMN 14:
Line 66, “ranger” should read --range--.

UNITED STATES PATENT AND TRADEMARK OFFICE

CERTIFICATE OF CORRECTION

PATENT NO. : 7,058,337 B2
APPLICATION NO. : 10/840263
DATED : June 6, 2006
INVENTOR(S) : Koji Hashimoto et al.

It is certified that error appears in the above-identified patent and that said Letters Patent is hereby corrected as shown below:

COLUMN 15:
Line 3, "or" should read --of--.

COLUMN 17:
Line 5, "an" should read --a--.

COLUMN 18:
Line 34, "or" should read --of--.
Line 43, "thee" should read --the--.
Line 45, "cartridge 7" should read --cartridges 7--.

Signed and Sealed this

Tenth Day of July, 2007

JON W. DUDAS
*Director of the United States Patent and Trademark Office*